US007164357B2

(12) United States Patent
Hwang et al.

(10) Patent No.: US 7,164,357 B2
(45) Date of Patent: Jan. 16, 2007

(54) MAGNET SEAT IN A WARNING SYSTEM TO ENHANCE MAGNETIC FIELD

(76) Inventors: Shih-Ming Hwang, 3F, No. 8, Lane 31, Chungte St., Taipei (TW); James Chien-Jong Hwang, 3F, No. 8, Lane 31, Chungte St., Taipei (TW); Lawrence Liang-Lun Hwang, 3F, No. 8, Lane 31, Chungte St., Taipei (TW)

( * ) Notice: Subject to any disclaimer, the term of this patent is extended or adjusted under 35 U.S.C. 154(b) by 161 days.

(21) Appl. No.: 10/896,928

(22) Filed: Jul. 23, 2004

(65) Prior Publication Data

US 2006/0017567 A1 Jan. 26, 2006

(51) Int. Cl.
*G08B 13/08* (2006.01)
*G08B 21/00* (2006.01)

(52) U.S. Cl. ..... 340/547; 340/545.1; 340/546; 340/686.1; 116/204; 200/61.45 M; 335/205

(58) Field of Classification Search ..... 340/547; 200/65.45 M, 61.45 M
See application file for complete search history.

(56) References Cited

U.S. PATENT DOCUMENTS 3,974,469 A * 8/1976 Nicholls ..... 335/153
4,866,426 A * 9/1989 Evans et al. ..... 340/541
5,321,355 A * 6/1994 Luetzow ..... 324/207.2
5,635,887 A * 6/1997 Fischette et al. ..... 335/205

* cited by examiner

*Primary Examiner*—Donnie L. Crosland
(74) *Attorney, Agent, or Firm*—Bacon & Thomas, PLLC

(57) ABSTRACT

A magnet seat for engagement with a magnet in a warning system includes a base and a column extending upward from a side face of the base for extending through the magnet and having a stop formed on a free end of the bar for permanently fixing the position of the magnet on top of the base. Multiple slits are defined in the side face of the base for receiving therein glue. Supporting bars are concentrically located on the side face of the base for surrounding and supporting the magnet.

3 Claims, 10 Drawing Sheets

MAGNET SEAT IN A WARNING SYSTEM TO ENHANCE MAGNETIC FIELD

BACKGROUND OF THE INVENTION

1. Field of the Invention

The present invention relates to a magnet seat, and more particularly to a magnet seat in a warning system to enhance a magnetic field such that the warning system is able to be initiated effectively.

2. Description of Related Art

With reference to FIGS. 7 and 8, a conventional warning system includes a magnetic unit (7) and a sensing unit (8). The magnetic unit (7) is typically mounted in a fixed position inside a window (5), and the sensing unit (8) is typically mounted in a fixed position inside a window frame (6) at a position corresponding to the magnetic unit (7). When the warning system is on and the window (5) is pulled away from the window frame (6), because the sensing unit (8) is no longer able to sense the magnetic field from the magnetic unit (7), the warning system sends out a signal to trigger an alarm.

With reference to FIGS. 9 and 10, and still taking FIG. 7 for reference, it is noted that when taking into account the overall appearance of the window (5) and the window frame (6), the dimension of the magnetic unit (7) is limited to a certain extent.

The conventional magnetic unit (7) includes a hollow cylindrical casing (71) with a closed end and an open end. A magnet (72) having a dimension corresponding to the inner space inside the casing (71) is securely fixed in the casing (71) typically flush with the open end of the casing (71). However, because of the thickness of the casing (71), the magnetic field of the magnet (72) is influenced so that the magnetic field strength may not be able to effectively reach the sensing unit (8) as originally designed. Therefore, erroneous initiation of the warning system may result in a false alarm.

To overcome such shortcomings, the present invention provides an improved magnet seat to mitigate the aforementioned problems.

SUMMARY OF THE INVENTION

The primary objective of the present invention is to provide an improved magnet seat to effectively enhance the magnetic field of the magnet securely connected to the magnet seat.

Other objects, advantages and novel features of the invention will become more apparent from the following detailed description when taken in conjunction with the accompanying drawings.

DETAILED DESCRIPTION OF THE PREFERRED EMBODIMENT

Figure 1:
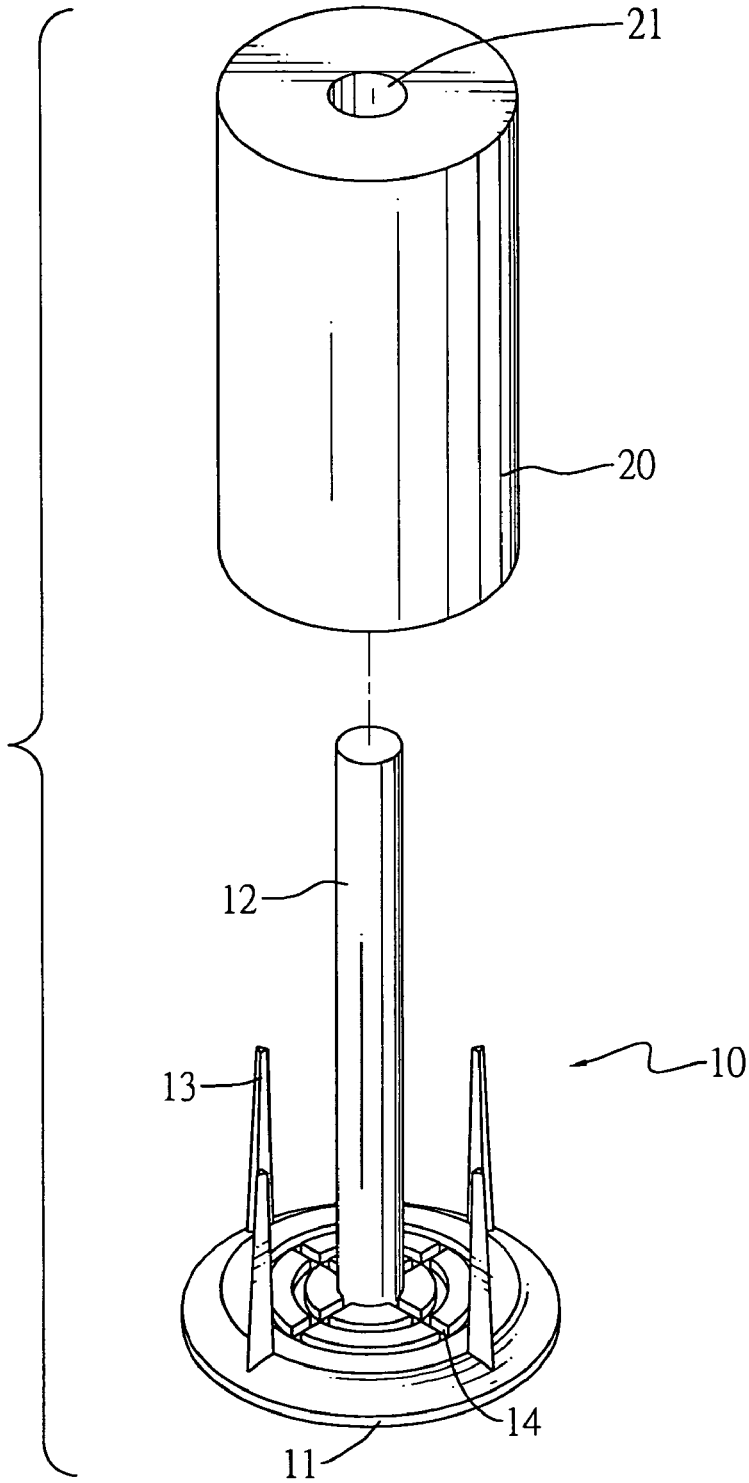
FIG. 1 is an exploded perspective view of the magnet seat of the present invention.

With reference to FIG. 1, a magnet seat (10) in accordance with the present invention includes a base (11), a column (12) extending upward from a side face of the base (11), multiple supporting bars (13) concentrically located on the side face of the base (11) and having a height lower than that of the column (12) and slits (14) defined in the side face of the base (11) and each extending between the column (12) and one of the supporting bars (13). The slits (14) can be filled with glue (not shown). The magnet (20) is cylindrical and has a hole (21) longitudinally extending through its center which allows the magnet (20) to be fixed in place over the column (12).

Figure 2:
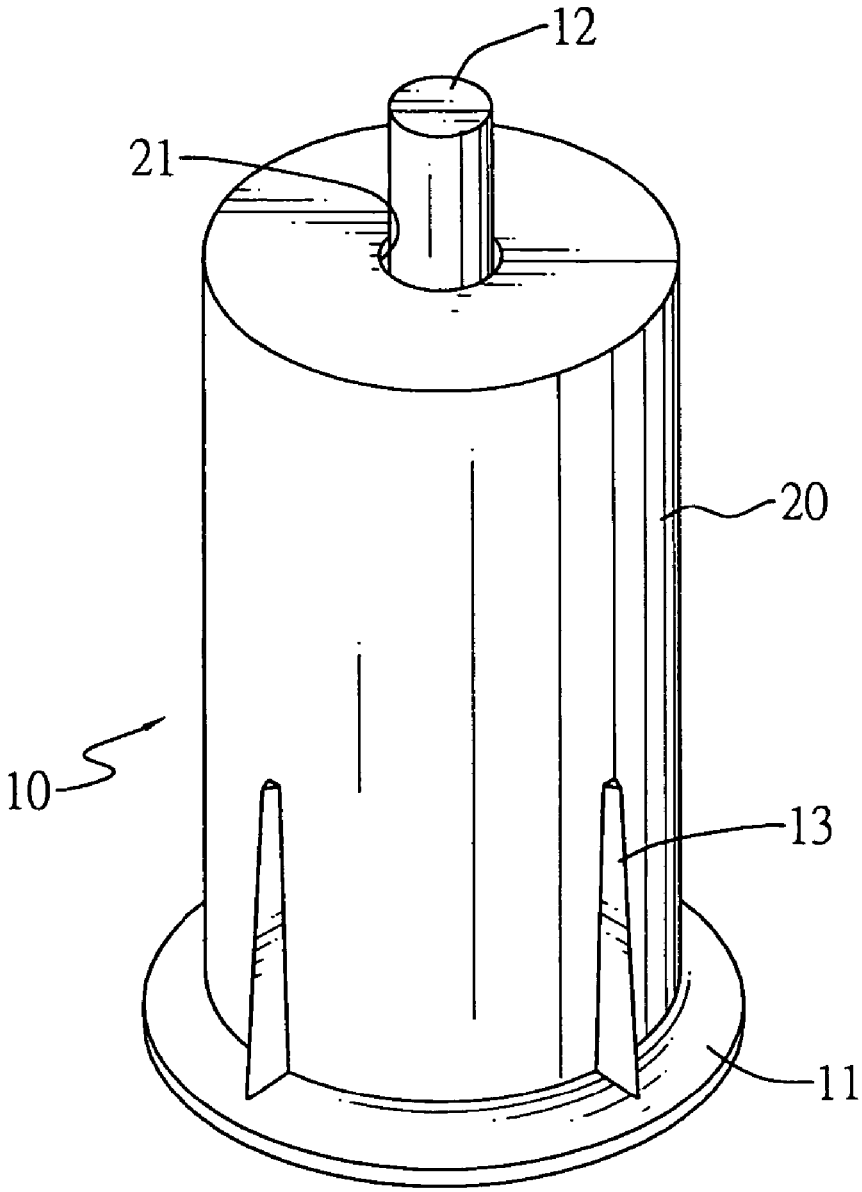
FIG. 2 is a perspective view showing the combination of the magnet seat and the magnet.
Figure 3:
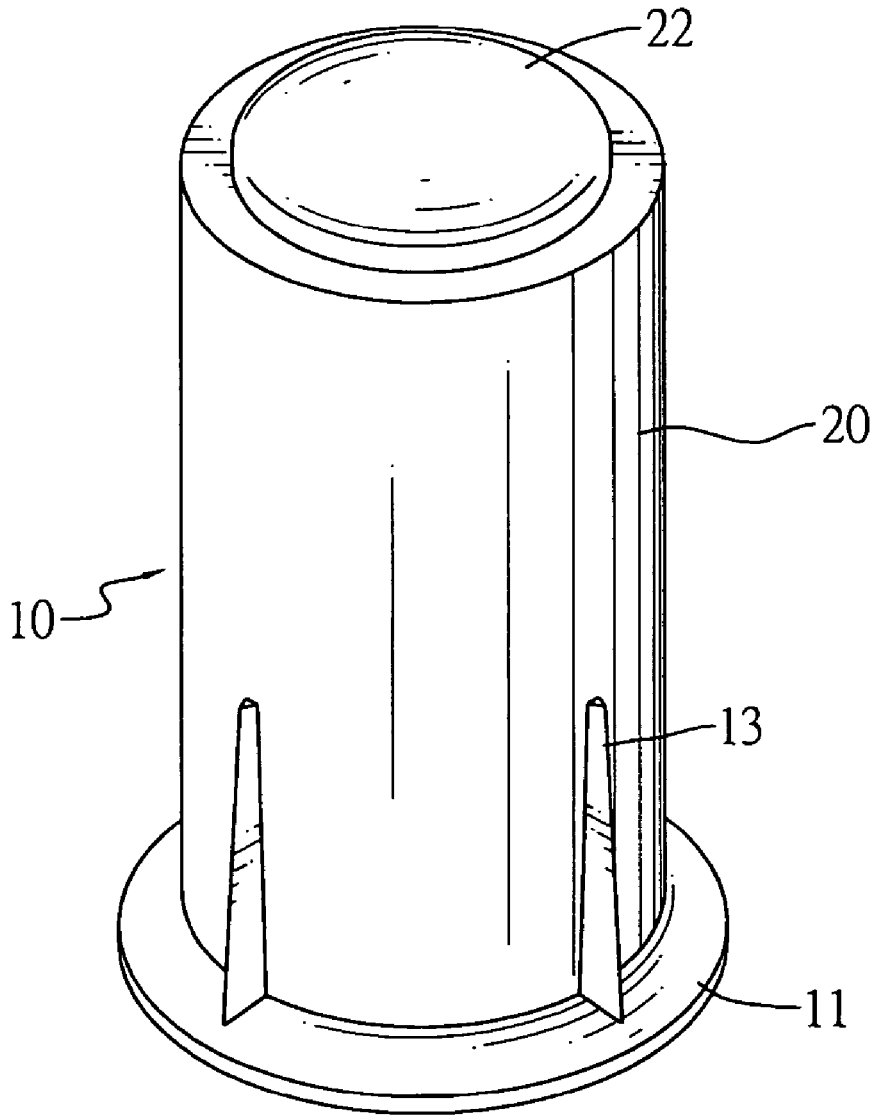
FIG. 3 is a perspective view showing that the free end of the fixing bar is deformed to fix the magnet in position.
Figure 4:
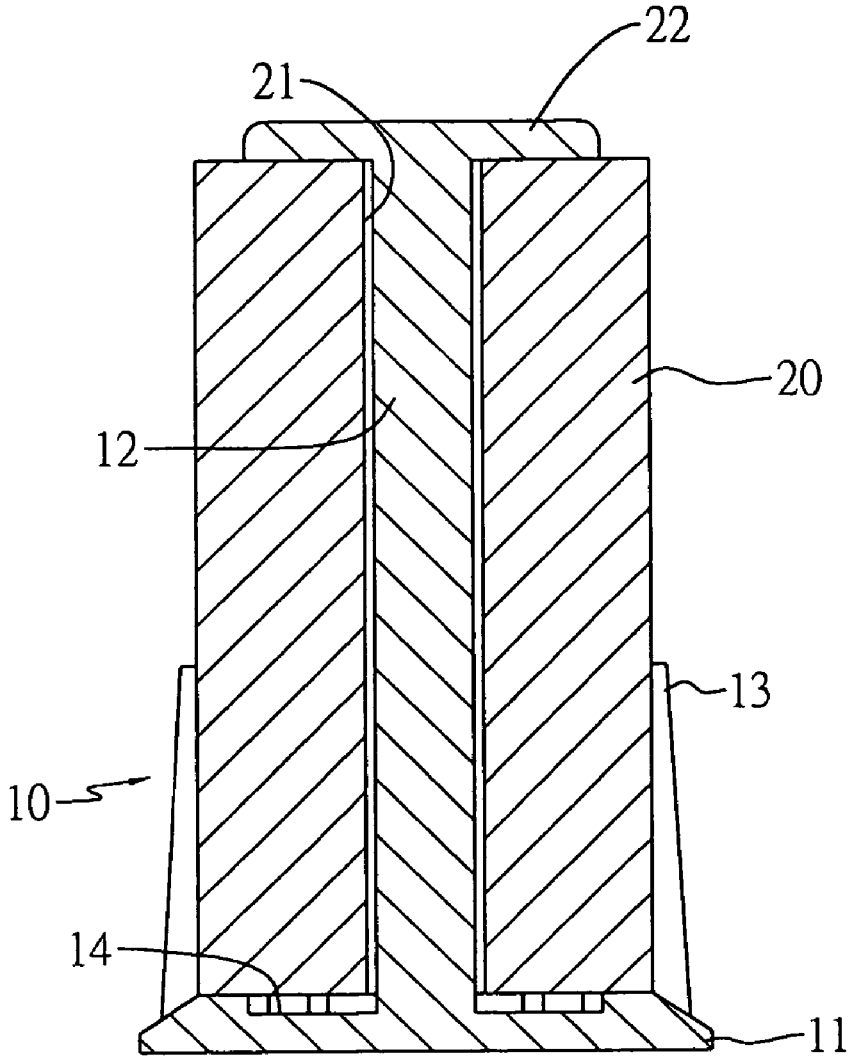
FIG. 4 is a cross sectional view showing the structure in FIG. 3.

With reference to FIGS. 2 and 3, it is noted that when the magnet seat (10) is combined with the magnet (20), the column (12) is extended through the hole (21) of the magnet (20). Because the column (12) has a height larger than that of the magnet (20), a free end of the column (12) is extended out of the hole (21). In the meantime, the supporting bars (13) are arranged around the magnet (20) to prevent movement of the magnet (20). The free end of the column (12) is deformed by an ultrasonic method or any other well-known methods in the art to form a stop (22) integrally formed on the free end of the column (12) to abut the top end of the magnet (20) so as to permanently fix the magnet (20) onto the magnet seat (10). In addition to the provision of the stop (22) and the supporting bars (13), the glue-filled slits (14) are able to securely attach the bottom end of the magnet (20) to the base (11).

It is to be noted that because there is no casing to surround the outer periphery of the magnet (20), the magnetic field of the magnet (20) will not be affected and therefore the magnetic field from the magnet (20) is able to reach the sensing unit as originally designed to effectively send out a warning signal as the window is pushed away from the window frame.

Figure 5:
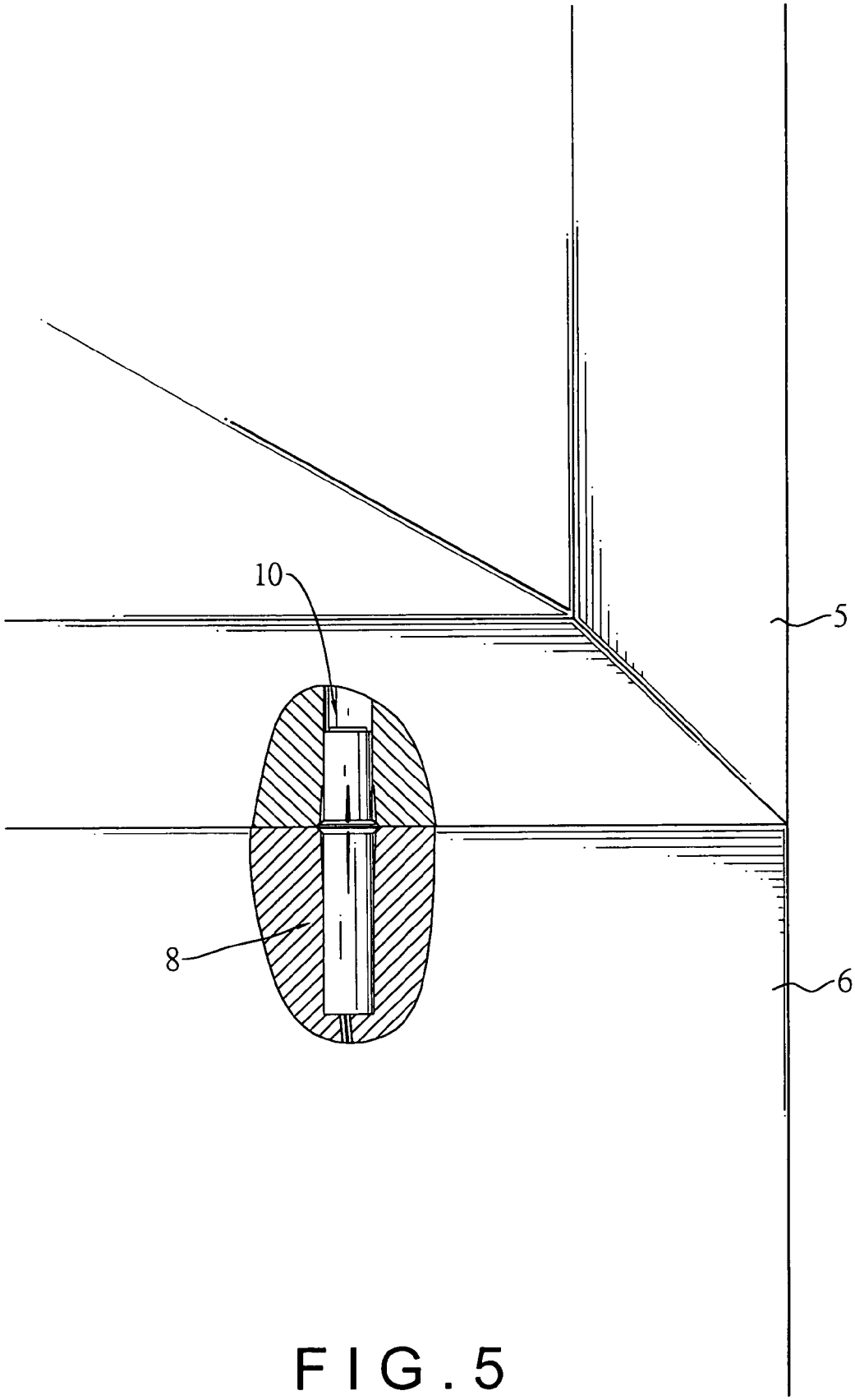
FIG. 5 is a schematic view showing the arrangement of the warning system made from the magnet seat of the present invention.
Figure 6:
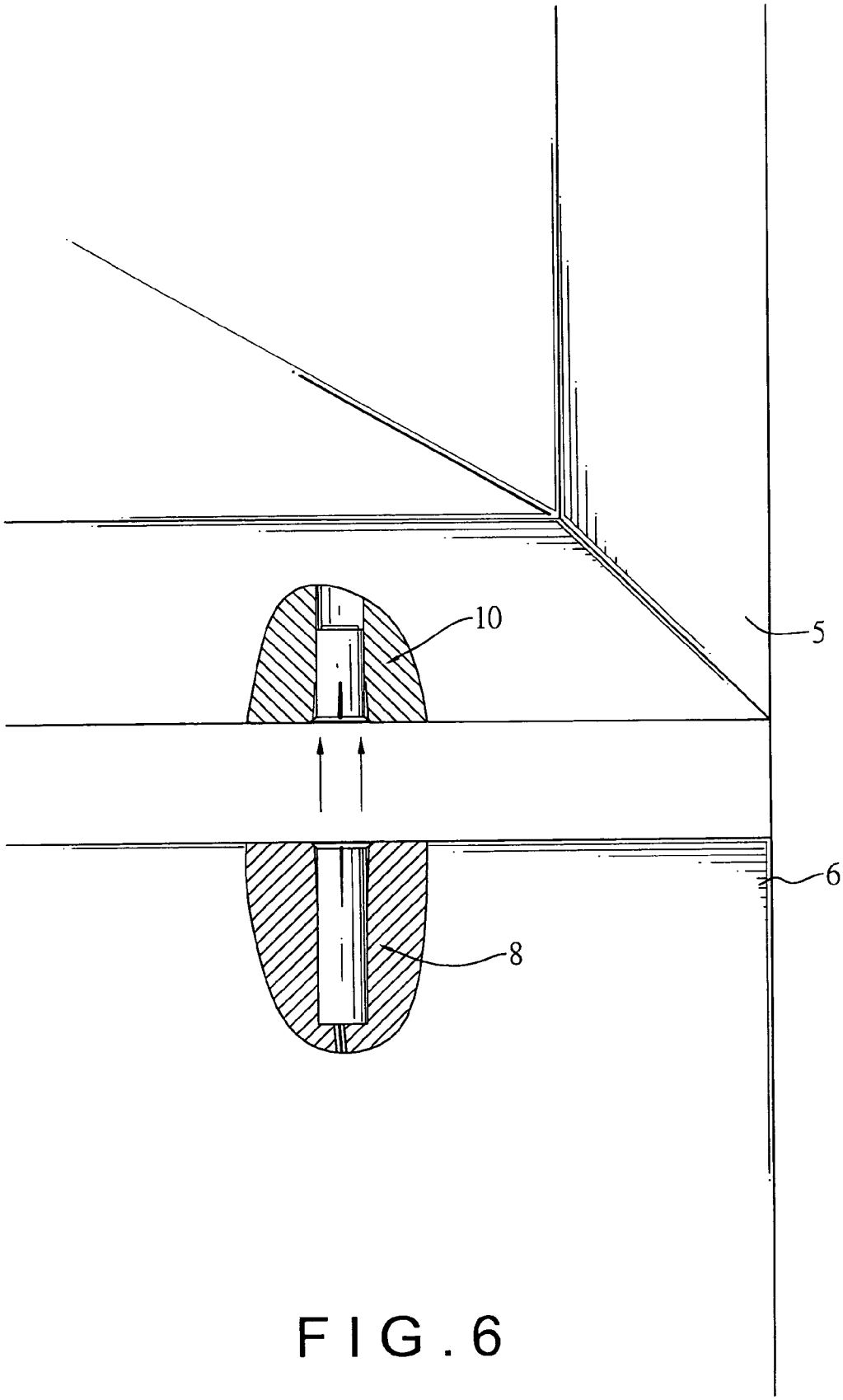
FIG. 6 is a schematic view showing the triggering of the warning system in FIG. 5.
Figure 7:
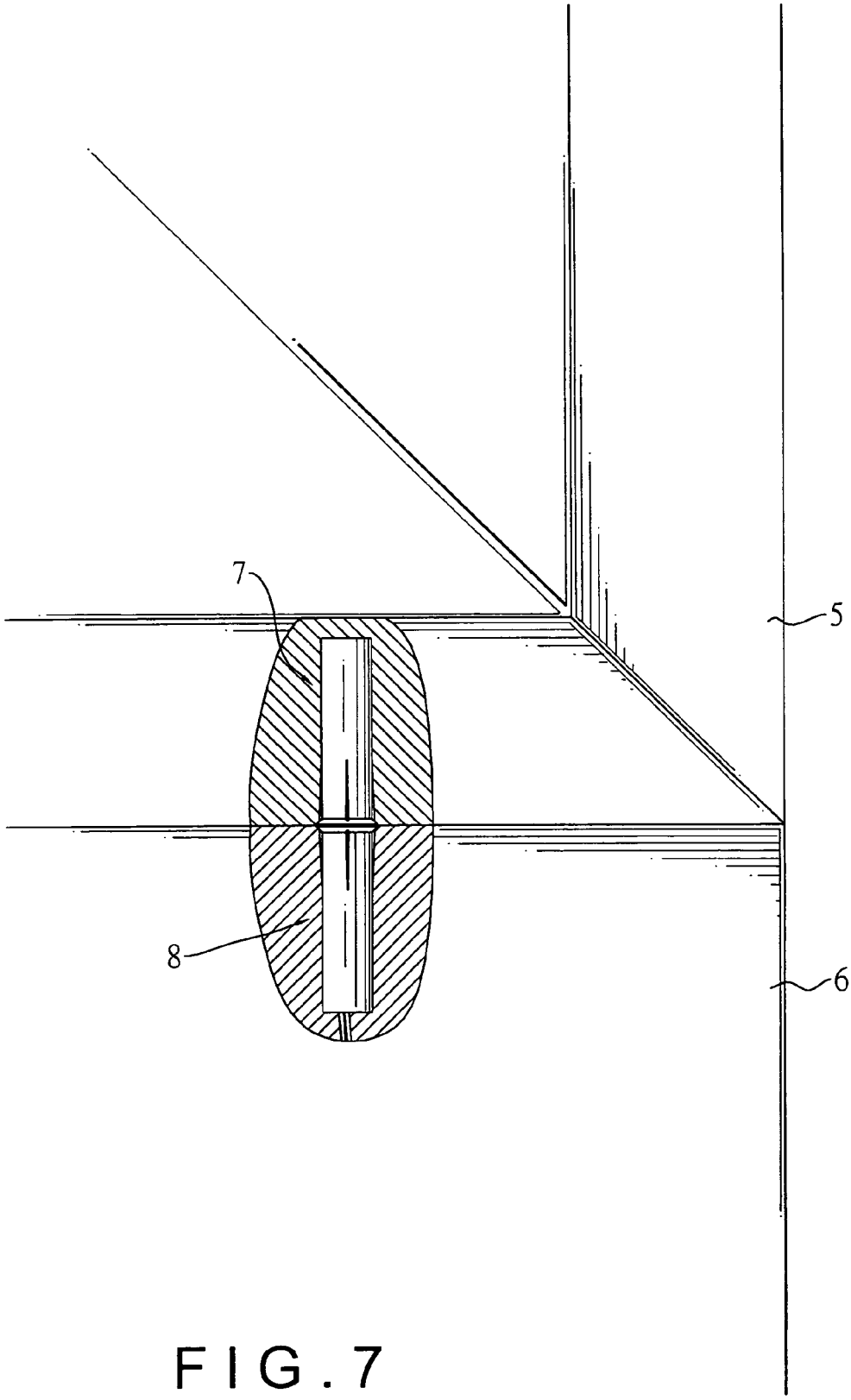
FIG. 7 PRIOR ART
FIG. 7 is a schematic view showing the mounting of a conventional warning system.
Figure 8:
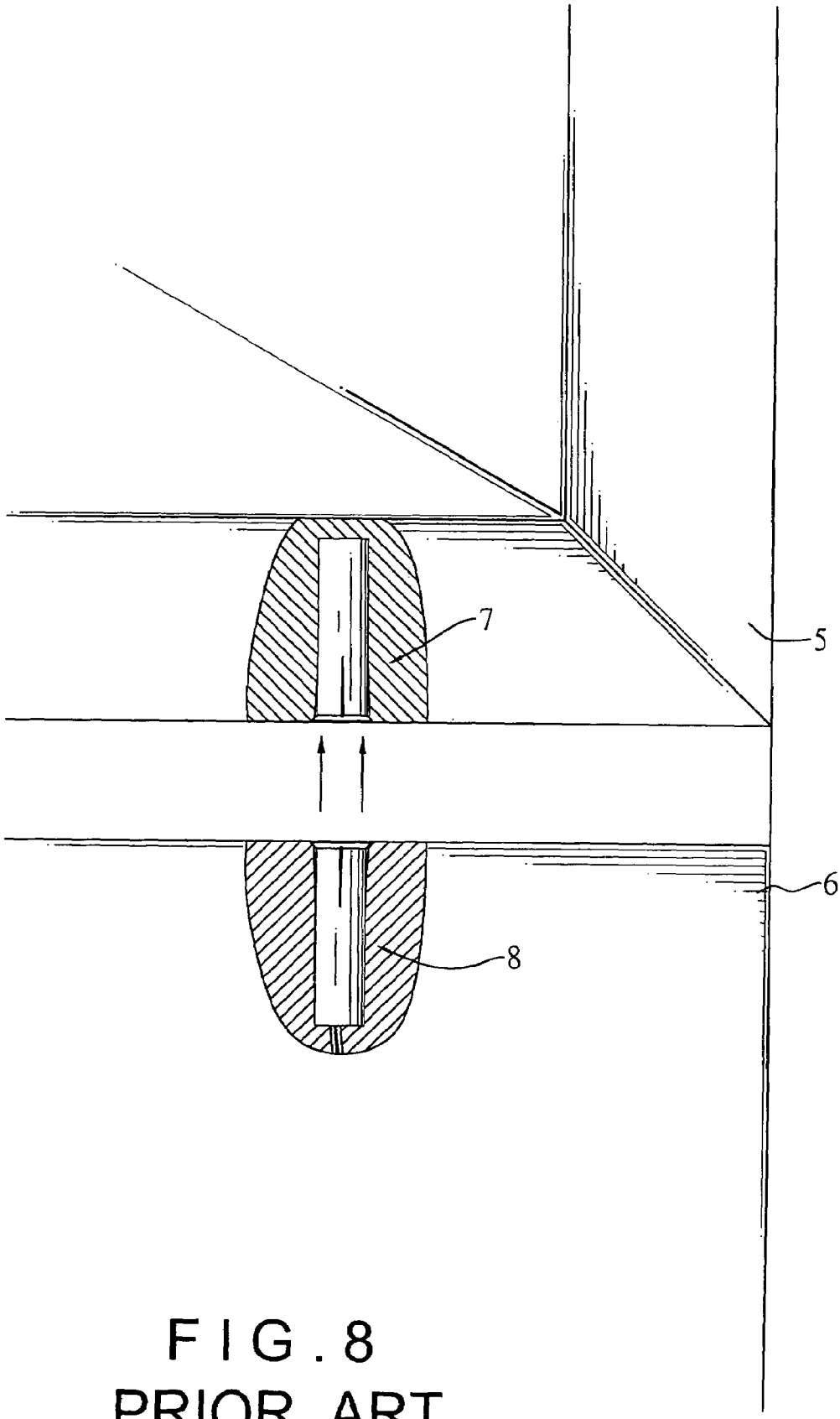
FIG. 8 PRIOR ART
FIG. 8 is a schematic view showing the triggering of the conventional warning system.
Figure 9:
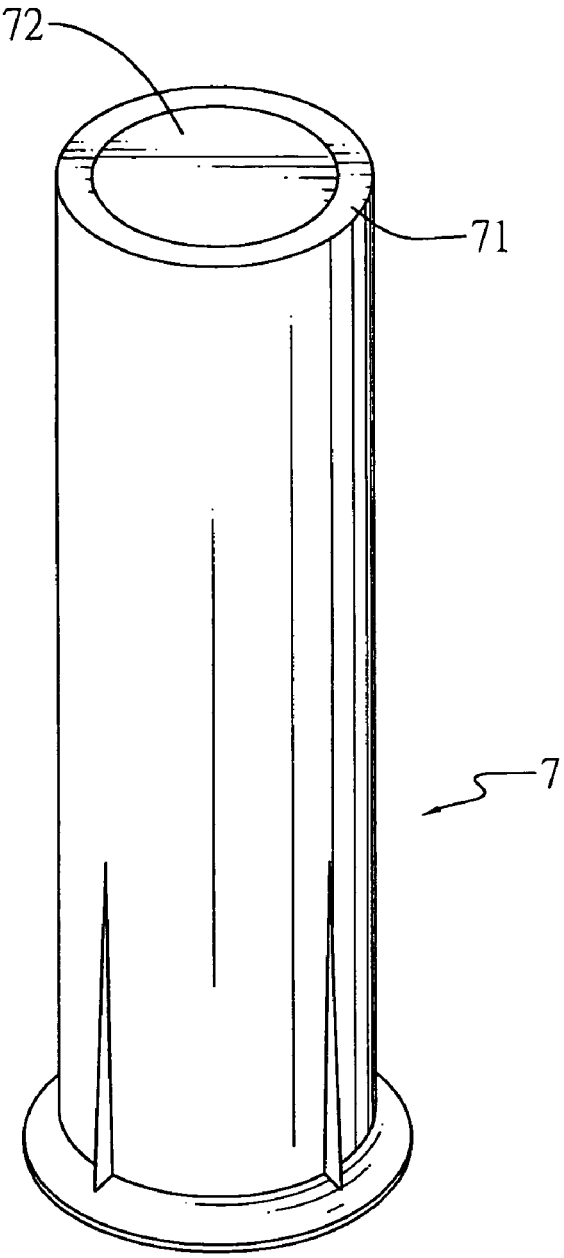
FIG. 9 PRIOR ART
FIG. 9 is a perspective view of a conventional magnetic unit in the warning system.
Figure 10:
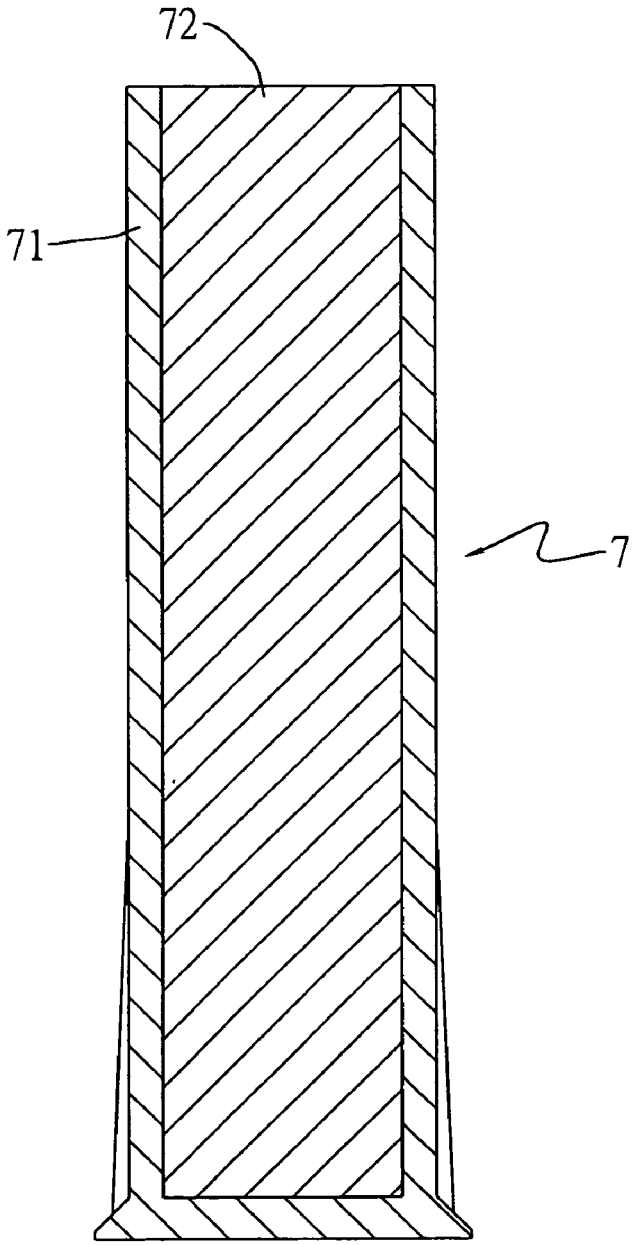
FIG. 10 PRIOR ART
FIG. 10 is a cross sectional view showing the conventional magnetic unit.

With reference to FIGS. 5 and 6, it is noted that when the magnet (20) is mounted onto the magnet seat (10) of the present invention to form a warning system, due to the removal of the casing to the magnet, interference to the magnetic field of the magnet (20) by such as pushing the window is able to effectively sound an alarm.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A magnet seat for engagement with a magnet of a warning system, the magnet seat comprising:

a base; and a column extending upward from a side face of said base for extending through said magnet and having a stop integrally formed on a free end of said column for permanently fixing the position of said magnet on top of said base after the column extends through the magnet.

2. The magnet seat as claimed in claim 1, wherein slits are defined in the side face of said base for receiving therein glue.

3. The magnet seat as claimed in claim 2, wherein supporting bars are concentrically located on the side face of said base for surrounding and supporting said magnet and the slits each extend between the column and one of the supporting bars.

* * * * *